US008508328B1

(12) United States Patent
Chen et al.

(10) Patent No.: US 8,508,328 B1
(45) Date of Patent: Aug. 13, 2013

(54) INSERTABLE POLYMER PTC OVER-CURRENT PROTECTION DEVICE

(75) Inventors: Jack Jih-Sang Chen, New Taipei (TW); Chang-Hung Jiang, New Taipei (TW)

(73) Assignee: Fuzetec Technology Co., Ltd., New Taipei (TW)

( * ) Notice: Subject to any disclaimer, the term of this patent is extended or adjusted under 35 U.S.C. 154(b) by 0 days.

(21) Appl. No.: 13/616,100

(22) Filed: Sep. 14, 2012

(51) Int. Cl.
*H01C 7/10* (2006.01)

(52) U.S. Cl.
USPC ..... 338/22 R; 338/13; 338/21; 338/20

(58) Field of Classification Search
USPC ..... 338/22 R, 20, 21, 13
See application file for complete search history.

(56) References Cited

U.S. PATENT DOCUMENTS 4,238,812 A 12/1980 Middleman et al.
4,873,507 A * 10/1989 Antonas ..... 338/22 R
5,201,517 A * 4/1993 Stemmle ..... 271/291
7,148,785 B2 * 12/2006 Becker et al. ..... 338/22 R
7,355,504 B2 * 4/2008 Graves et al. ..... 338/22 R
7,609,143 B2 * 10/2009 Huang ..... 338/22 R
8,446,245 B2 * 5/2013 Wang et al. ..... 338/21

* cited by examiner

*Primary Examiner* — Kyung Lee
(74) *Attorney, Agent, or Firm* — Morgan, Lewis & Bockius LLP

(57) ABSTRACT

An insertable PPTC over-current protection device includes: first and second electrodes; a solder material; conductive lead pins bonded to the first and second electrodes, respectively, each of the lead pins having a connecting segment extending along and bonded to an outer surface of the respective one of the first and second electrodes through the solder material, and a free segment extending outwardly from the connecting segment beyond a peripheral edge of the respective one of the first and second electrodes; and a PTC polymer matrix laminated between the first and second electrodes. The PTC polymer matrix is formed with at least one hole that has an effective volume to accommodate thermal expansion of the PTC polymer matrix.

9 Claims, 8 Drawing Sheets

INSERTABLE POLYMER PTC OVER-CURRENT PROTECTION DEVICE

BACKGROUND OF THE INVENTION

1. Field of the Invention

This invention relates to an insertable polymer positive temperature coefficient (PPTC) over-current protection device, and more particularly to an insertable PPTC over-current protection device including a PTC polymer matrix formed with at least one hole.

2. Description of the Related Art

U.S. Pat. No. 4,238,812 discloses an over-current protection device that includes a thin film PTC element, two electrodes formed on two opposite surfaces of the PTC element, and two conductive lead pins attached to the electrodes, respectively. The PTC element can be made from a polymer material containing a conductive filler.

There is a need to enhance the electrical properties, such as the high-voltage endurability, of the over-current protection device so as to protect the over-current protection device from being damaged by an overvoltage. Although the high-voltage endurability can be enhanced by increasing the area or the thickness of the PTC element, the size of the over-current protection device is undesirably increased.

SUMMARY OF THE INVENTION

Therefore, an object of the present invention is to provide an insertable PPTC over-current protection device that can overcome the aforesaid drawback associated with the prior art.

According to this invention, there is provided an insertable PPTC over-current protection device that comprises: first and second electrodes, each of which has an outer surface and a peripheral edge; a solder material; conductive lead pins bonded to the first and second electrodes, respectively, each of the lead pins having a connecting segment extending along and bonded to the outer surface of the respective one of the first and second electrodes through the solder material, and a free segment extending outwardly from the connecting segment beyond the peripheral edge of the respective one of the first and second electrodes; and a PTC polymer matrix laminated between the first and second electrodes and having two opposite surfaces and a peripheral edge. The opposite surfaces of the PTC polymer matrix are in contact with the first and second electrodes, respectively. The PTC polymer matrix is formed with at least one hole that extends between the opposite surfaces of the PTC polymer matrix, that is spaced apart from and that is surrounded by the peripheral edge of the PTC polymer matrix, and that has an effective volume to accommodate thermal expansion of the PTC polymer matrix when temperature of the PTC polymer matrix is increased.

BRIEF DESCRIPTION OF THE DRAWINGS

In drawings which illustrate embodiments of the invention.

DETAILED DESCRIPTION OF THE PREFERRED EMBODIMENTS

Figure 1:
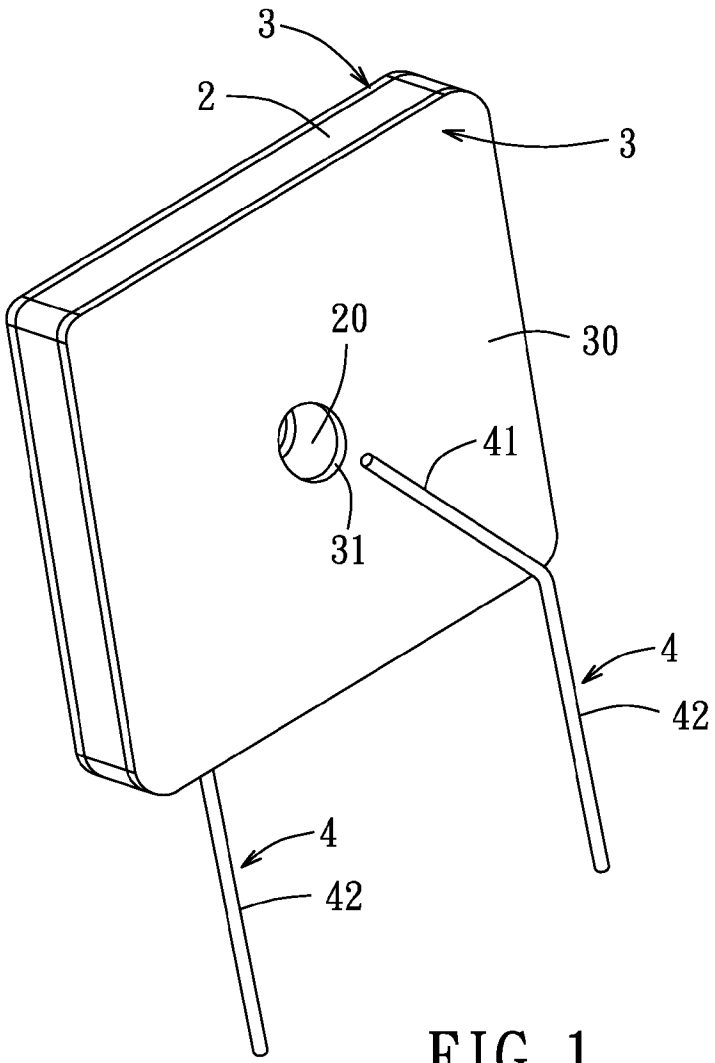
FIG. 1 is an assembled perspective view of the first preferred embodiment of an insertable PPTC over-current protection device according to the present invention.

Before the present invention is described in greater detail with reference to the accompanying preferred embodiments, it should be noted herein that like elements are denoted by the same reference numerals throughout the disclosure.

Figure 2:
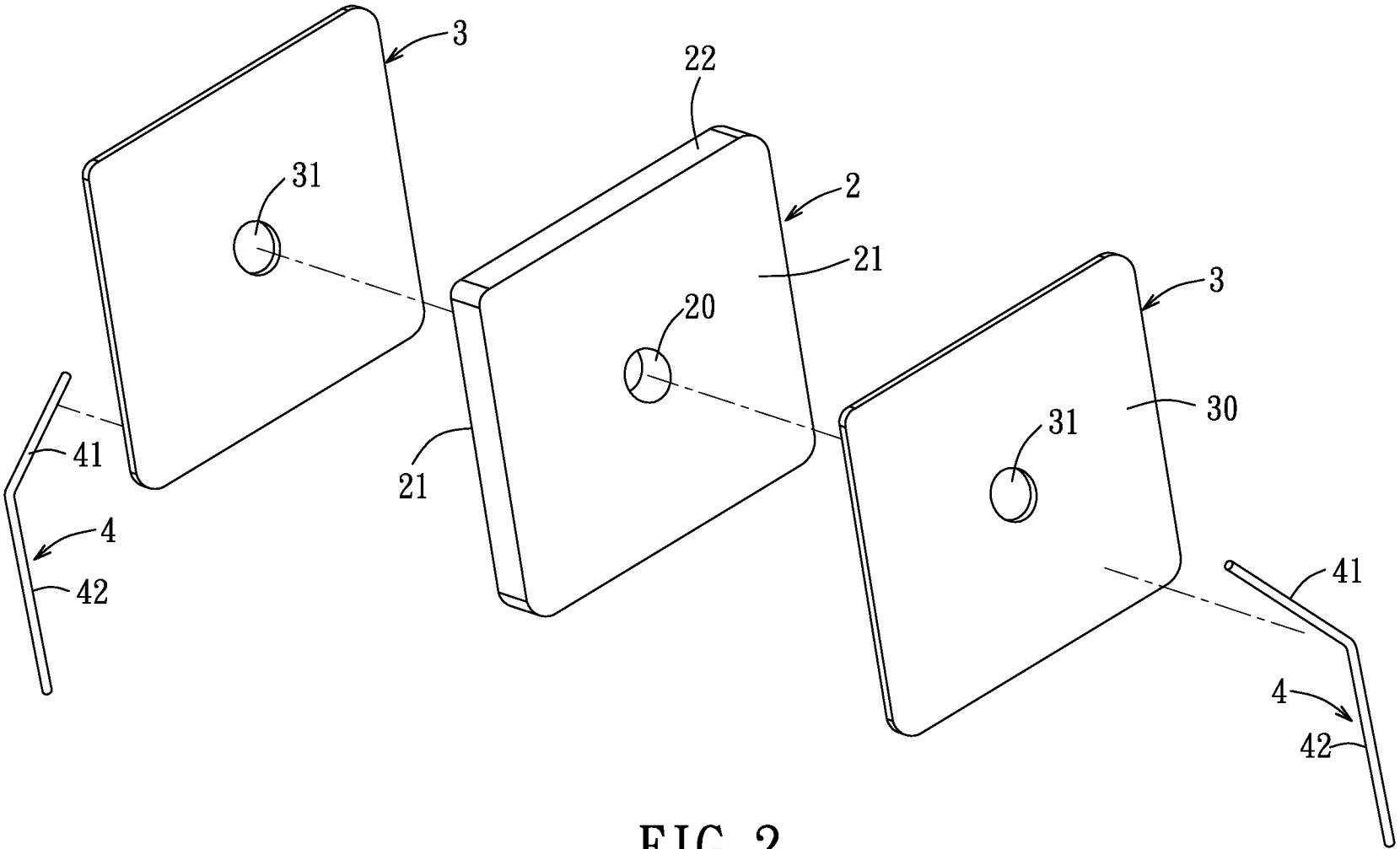
FIG. 2 is an exploded perspective view of the first preferred embodiment.
Figure 3:
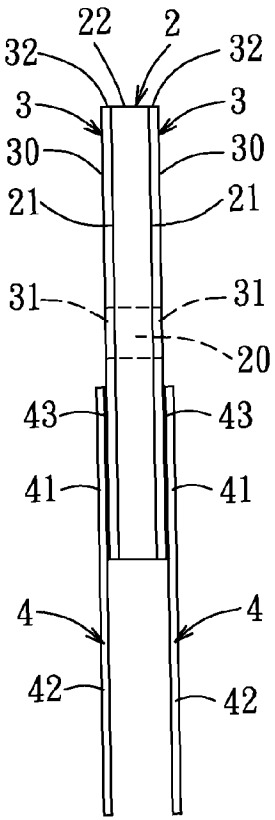
FIG. 3 is a schematic side view of the first preferred embodiment.

FIGS. 1 to 3 illustrate the first preferred embodiment of an insertable PPTC over-current protection device according to the present invention. The insertable PPTC over-current protection device includes: planar first and second electrodes 3, each of which has an outer surface 30 and a peripheral edge 32; a solder material 43; conductive lead pins 4 bonded to the first and second electrodes 3, respectively, each of the lead pins 4 having a connecting segment 41 extending along and bonded substantially entirely to the outer surface 30 of the respective one of the first and second electrodes 3 through the solder material 43, and a free segment 42 extending outwardly from the connecting segment 41 beyond the peripheral edge 32 of the respective one of the first and second electrodes 3 for insertion into a pin hole in a circuit board or a circuit device (not shown); and a planar PTC polymer matrix 2 laminated between the first and second electrodes 3 and having two opposite surfaces 21 and a peripheral edge 22. The opposite surfaces 21 of the PTC polymer matrix 2 are opposite to each other in a normal direction and are in contact with the first and second electrodes 3, respectively. The PTC polymer matrix 2 is formed with at least one hole 20 that extends in the normal direction between the opposite surfaces 21 of the PTC polymer matrix 2, that is spaced apart from and that is surrounded by the peripheral edge 22 of the PTC polymer matrix 2, and that has an effective volume to accommodate thermal expansion of the PTC polymer matrix 2 when temperature of the PTC polymer matrix 2 is increased so as to prevent undesired structural deformation from occurring in the PTC polymer matrix 2. The structural deformation can have an adverse effect on the electrical properties of the PTC polymer matrix 2 and reduce the reliability of the PTC polymer matrix 2.

In this embodiment, the hole 20 in the PTC polymer matrix 2 is a through-hole extending through the opposite surfaces 21 of the PTC polymer matrix 2, has a circular periphery, and extends along a line (not shown) passing through a geometrical center of the PTC polymer matrix 2 and transverse to the opposite surfaces 21 of the PTC polymer matrix 2. Alternatively, the hole periphery of the hole 20 in the PTC polymer matrix 2 can be square, oval, triangular, or crisscross in shape.

Each of the first and second electrodes 3 is formed with an opening 31 in spatial communication and aligned with the hole 20 in the PTC polymer matrix 2.

The PTC polymer matrix 2 is made of a PTC composition that comprises a non-grafted olefin-based polymer, optionally an unsaturated carboxylic acid grafted olefin-based polymer, and a conductive filler dispersed therein. Preferably, the non-grafted olefin-based polymer is non-grafted high density polyethylene (HDPE), and the unsaturated carboxylic acid grafted olefin-based polymer is carboxylic acid anhydride grafted HDPE. Preferably, the conductive filler is carbon black, metal powders, or conductive ceramic powders.

Figure 4:
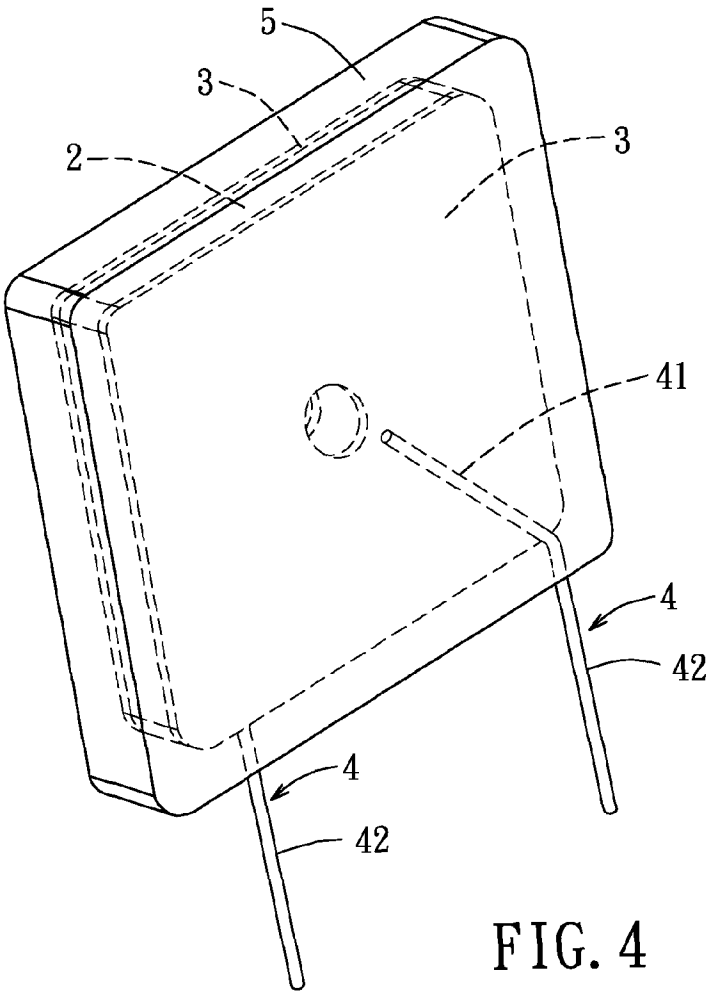
FIG. 4 is a perspective view of the second preferred embodiment of an insertable PPTC over-current protection device according to the present invention.

FIG. 4 illustrates the second preferred embodiment of an insertable PPTC over-current protection device according to the present invention. The second preferred embodiment differs from the previous embodiment in that the second embodiment further includes an encapsulant material 5 enclosing an assembly of the first and second electrodes 3, the PTC polymer matrix 2, and a portion of each of the lead pins 4. The remaining portions of the lead pins 4 are exposed from the encapsulant material 5. Preferably, the encapsulant material 5 is epoxy resin.

Figure 5:
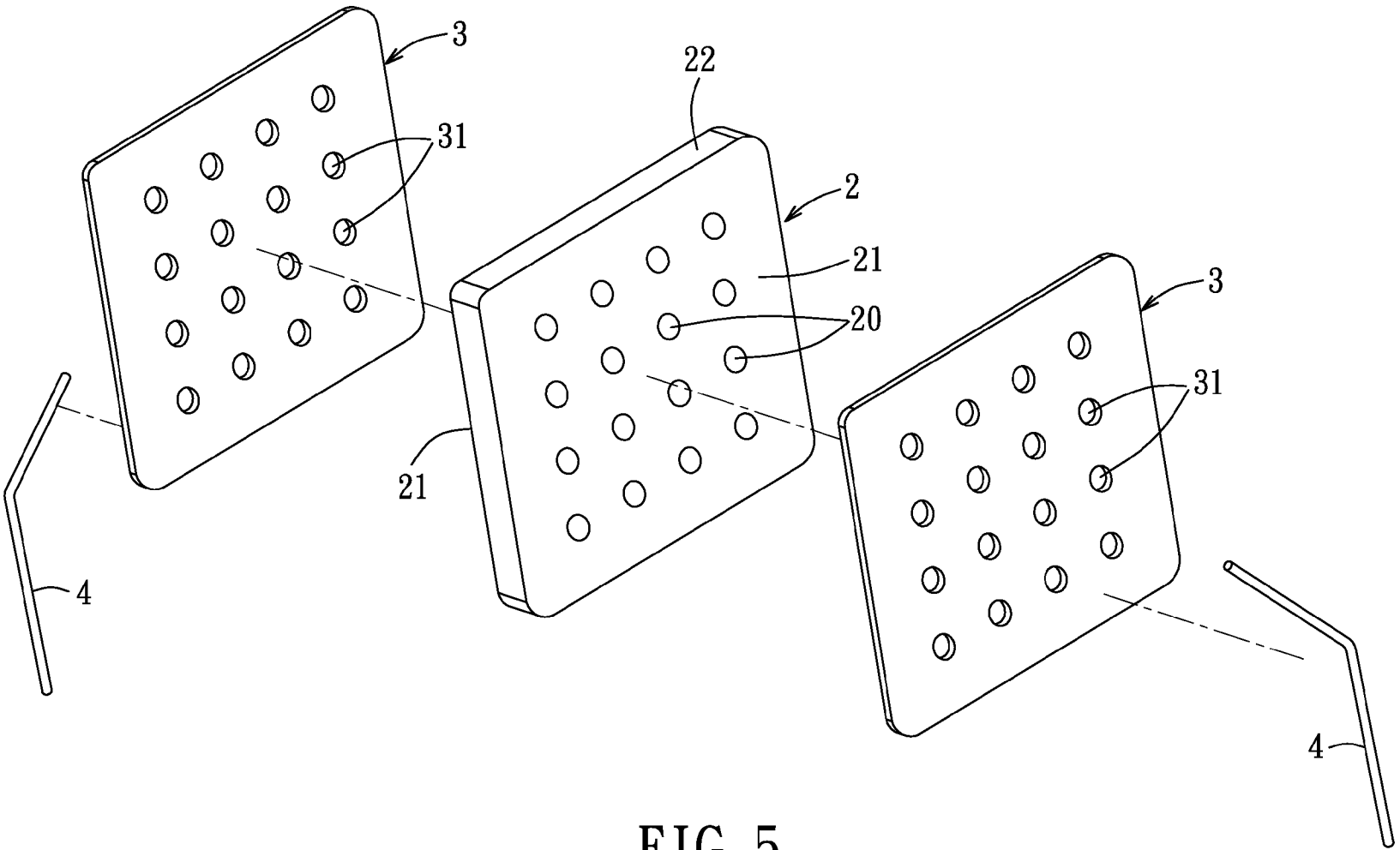
FIG. 5 is an exploded perspective view of the third preferred embodiment of an insertable PPTC over-current protection device according to the present invention.

FIG. 5 illustrates the third preferred embodiment of an insertable PPTC over-current protection device according to the present invention. The third preferred embodiment differs from the first preferred embodiment in that the PTC polymer matrix 2 is formed with a plurality of holes 20 and that each of the first and second electrodes 3 is formed with a plurality of openings 31 corresponding to the holes 20 in the PTC polymer matrix 2, respectively. The holes 20 in the PTC polymer matrix 2 are evenly distributed.

Figure 6:
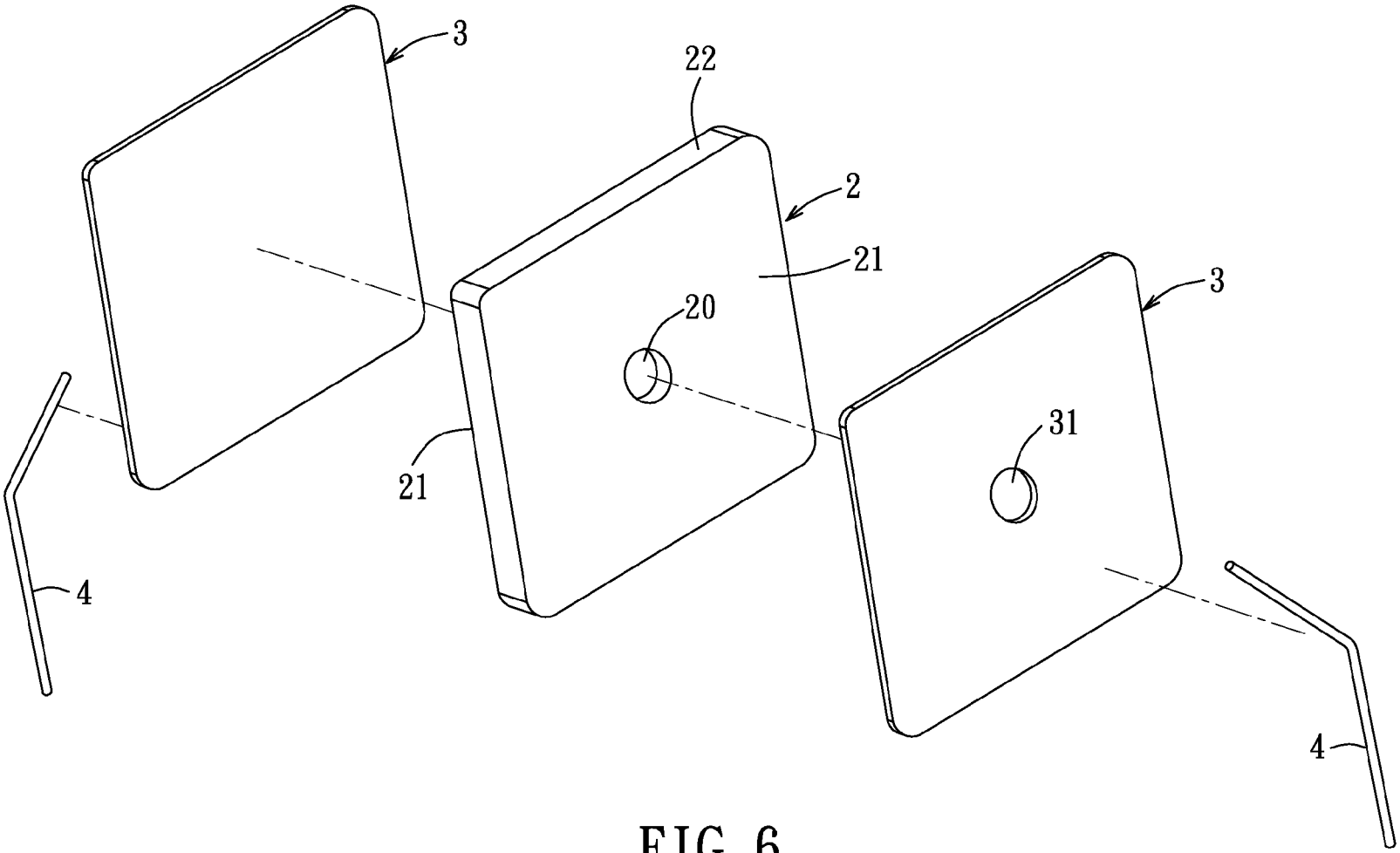
FIG. 6 is an exploded perspective view of the fourth preferred embodiment of an insertable PPTC over-current protection device according to the present invention.
Figure 7:
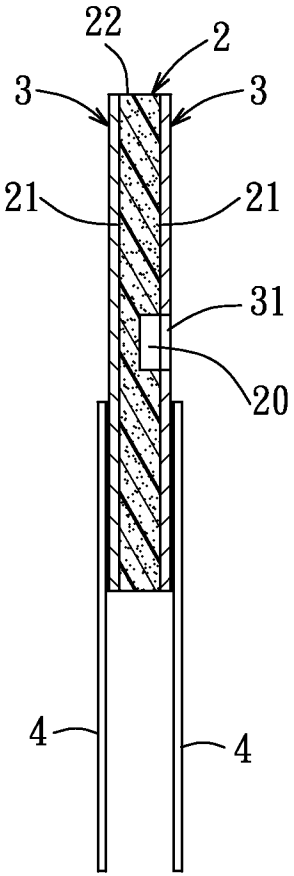
FIG. 7 is a sectional view of the fourth preferred embodiment.

FIGS. 6 and 7 illustrate the fourth preferred embodiment of the insertable PPTC over-current protection device according to the present invention. The fourth preferred embodiment differs from the first preferred embodiment in that the hole 20 in the PTC polymer matrix 2 is a blind hole extending through only one of the opposite surfaces 21 of the PTC polymer matrix 2. Thus, the second electrode 3 that contacts the surface 21 of the PTC polymer matrix 2 in which the hole 20 is not extended is not formed with an opening.

Figure 8:
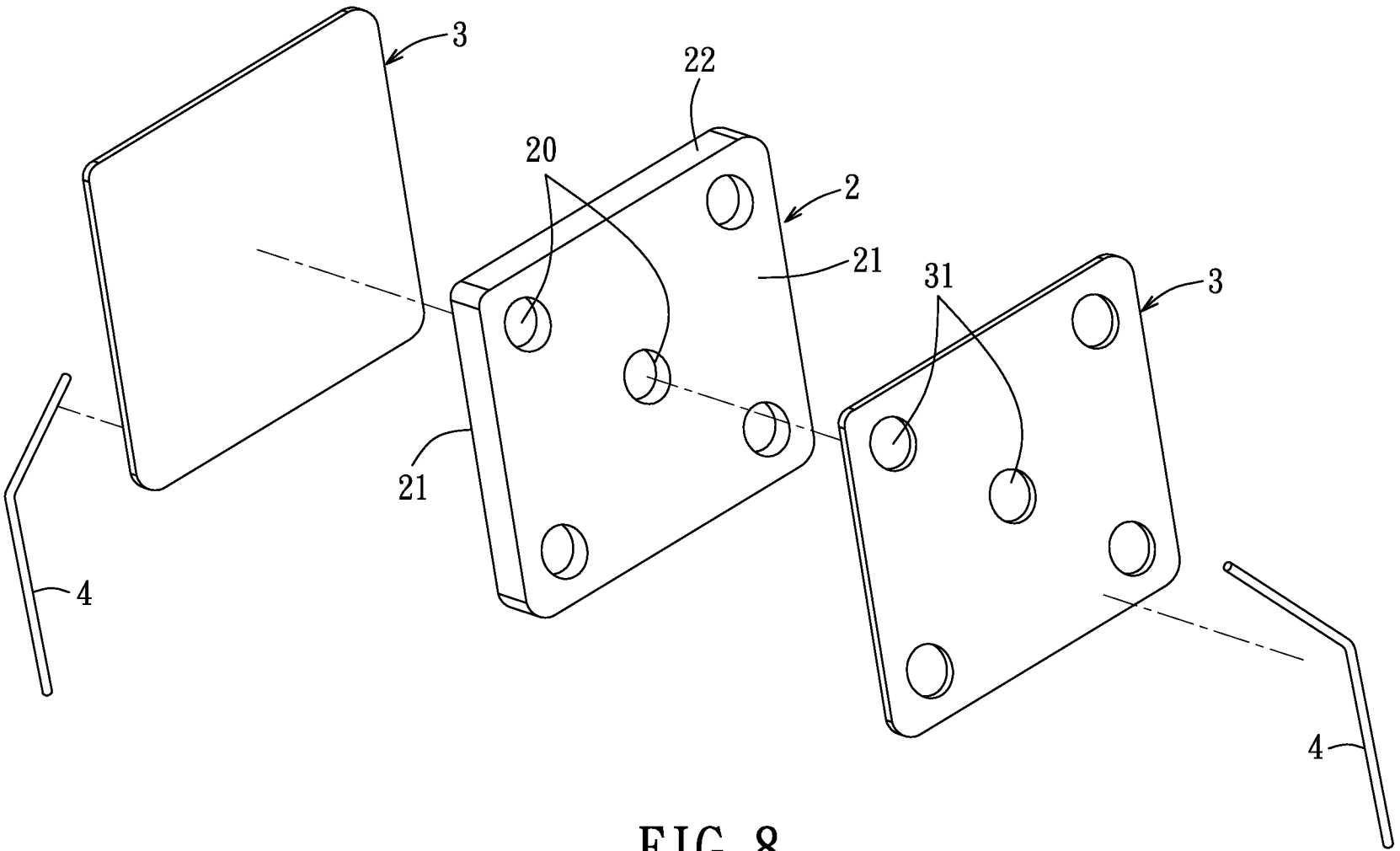
FIG. 8 is an exploded perspective view of the fifth preferred embodiment of an insertable PPTC over-current protection device according to the present invention.

FIG. 8 illustrates the fifth preferred embodiment of an insertable PPTC over-current protection device according to the present invention. The fifth preferred embodiment differs from the fourth preferred embodiment in that the PTC polymer matrix 2 is formed with a plurality of blind holes 20 and that the first electrode 3 that contacts the surface 21 of the PTC polymer matrix 2 through which the blind holes 20 are extended is formed with a plurality of openings 31.

The following examples and comparative examples are provided to illustrate the preferred embodiments of the invention, and should not be construed as limiting the scope of the invention.

EXAMPLE

Example 1 (E1)

10.925 grams of HDPE (polymer 1, purchased from Formosa Plastics Corp., catalog no.: HDPE9002), 10.925 grams of carboxylic acid anhydride grafted HDPE (G-HDPE, polymer 2, purchased from DuPont, catalog no.: MB100D), and 28.15 grams of carbon black powder (purchased from Columbian Chemicals Co., catalog no. Raven 430UB) were compounded in a Brabender mixer. The compounding temperature was 200° C., the stirring rate was 30 rpm, and the compounding time was 10 minutes. The compounded mixture was hot pressed in a mold so as to form a PTC polymer matrix having a thickness of 0.35 mm. The hot pressing temperature was 200° C., the hot pressing time was 4 minutes, and the hot pressing pressure was 80 kg/cm$^2$. Two copper foil sheets were respectively attached to two opposite surfaces of the PTC polymer matrix and were hot pressed under 200° C. and 80 kg/cm$^2$ for 4 minutes to form a sandwiched structure of a PTC laminate. The PTC laminate was cut into a plurality of chips with a chip size of 13.5 mm×13.5 mm. Each chip was irradiated with a Co-60 gamma ray for a total irradiating dose of 150 kGy, and was subsequently punched to form a through-hole (having a circular hole periphery with a diameter (d) of 1.5 mm and a hole area ($\pi d^2/4$) of 1.77 mm$^2$) in a central portion of the PTC polymer matrix and an opening in each of the copper foil sheets. A pair of conductive leads were then welded to the copper foil sheets of each chip, respectively, so as to form an insertable PPTC over-current protection chip-sized device. The resistance of each chip-sized device thus formed was measured, and an average resistance of the chip-sized devices thus formed was calculated (see Table 1).

TABLE 1

| | | | Carbon | Hole(s) | | Chip electrical property | |
|---|---|---|---|---|---|---|---|
| | Polymer 1 Wt % | Polymer 2 Wt % | black powder Wt % | Shape of hole periphery | Total hole area mm$^2$ | Average resistance ohm | Volume Resistivity ohm-cm |
| E1 | 21.85 | 21.85 | 56.3 | Circular (one hole) | 1.77 | 0.0098 | 0.422 |
| E2 | 21.85 | 21.85 | 56.3 | Circular (one hole) | 36.32 | 0.012 | 0.4169 |
| E3 | 21.85 | 21.85 | 56.3 | Square (one hole) | 16 | 0.0108 | 0.4275 |
| E4 | 21.85 | 21.85 | 56.3 | Crisscross (one hole) | 20 | 0.0111 | 0.4288 |
| E5 | 21.85 | 21.85 | 56.3 | Circular (16 holes) | 28.32 | 0.0116 | 0.4251 |
| E6 | 21.85 | 21.85 | 56.3 | Circular (one blind hole) | 7.07 | 0.0115 | 0.4797 |
| E7 | 21.85 | 21.85 | 56.3 | Circular (five blind holes) | 8.85 | 0.0117 | 0.483 |
| CE1 | 21.85 | 21.85 | 56.3 | (No hole) | 0 | 0.0097 | 0.4196 |
| CE2 | 21.85 | 21.85 | 56.3 | One hole filled with epoxy | 0 | 0.0095 | 0.4118 |
| CE3 | 21.85 | 21.85 | 56.3 | Two semi-circular holes formed at peripheral edge | 1.77 | 0.0097 | 0.427 |

Examples 2-5 (E2-E5)

The procedures and conditions in preparing the chip-sized devices of Examples 2-5 were similar to those of Example 1 except for the shape, the hole diameter (or the total hole area), and/or the number of the hole(s) in the PTC polymer matrix (see Table 1).

Example 6 (E6)

The procedures and conditions in preparing the chip-sized devices of Example 6 were similar to those of Example 1 except for the hole diameter or the total hole area (see Table 1). In addition, the hole in the PTC polymer matrix of Example 6 was a blind hole (having a depth of about 0.175 mm) and was formed by drilling.

Example 7 (E7)

The procedures and conditions in preparing the chip-sized devices of Example 7 were similar to those of Example 1 except for the hole diameter or the total hole area and the number of the hole (s) (see Table 1). In addition, the holes in the PTC polymer matrix of Example 7 were blind holes (having a depth of 0.175 mm) and were formed by drilling.

Comparative Examples 1-3 (CE1-CE3)

Figure 9:
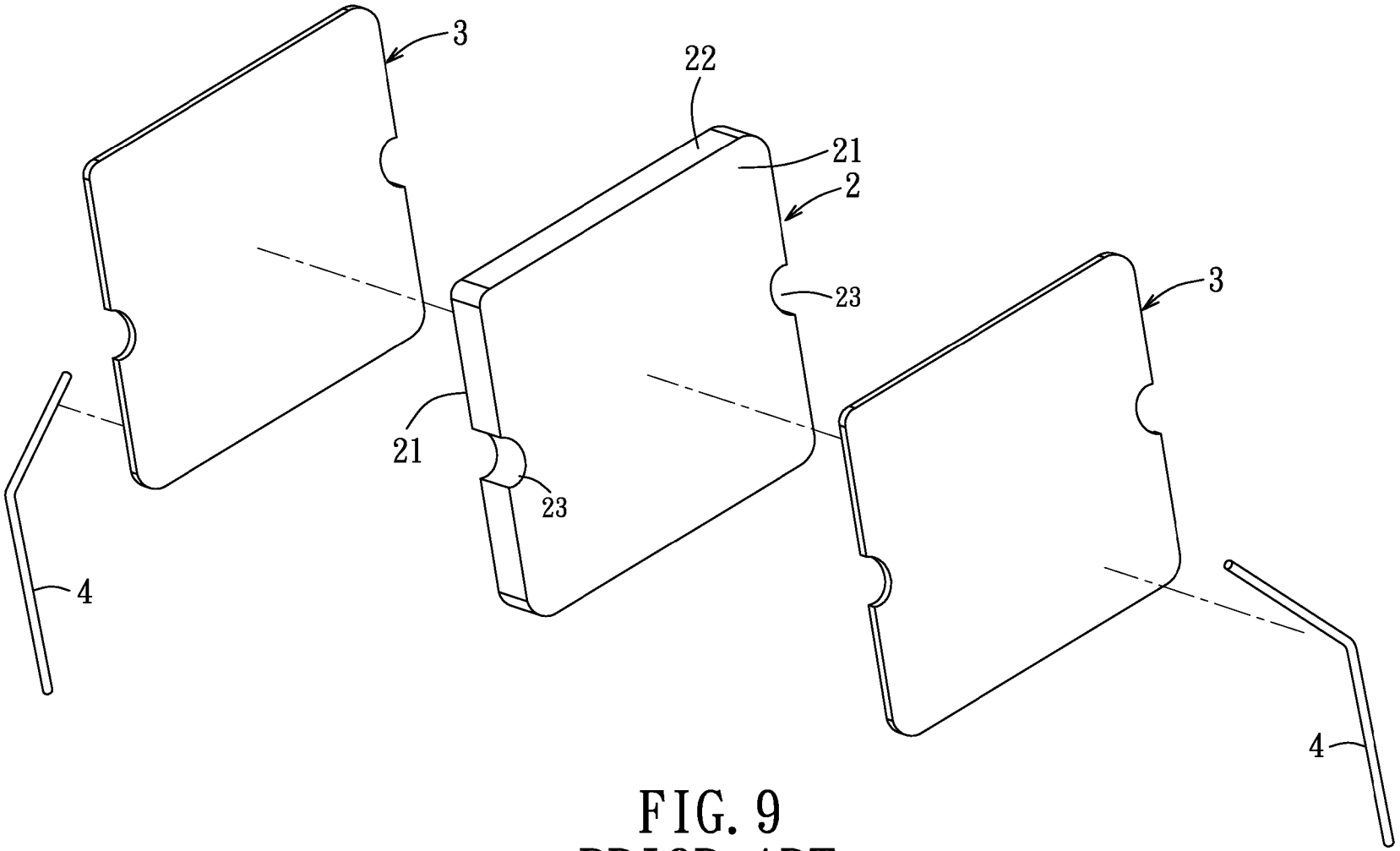
FIG. 9 PRIOR ART
FIG. 9 is an exploded perspective view of a conventional PPTC over-current protection device.

The procedures and conditions in preparing the chip-sized devices of Comparative Examples 1-3 were similar to those of Example 1, except that there is no hole formed in the PTC polymer matrix of each chip-sized device for Comparative Example 1, that there is a cured epoxy resin completely filling the hole (having a diameter of 1.5 mm and located at a position the same as that of the first preferred embodiment) in the PTC polymer matrix of each chip-sized device for Comparative Example 2, and that there are two semi-circular holes 23 formed in the PTC polymer matrix (as illustrated in FIG. 9, each semi-circular hole 23 having a diameter of 1.5 mm) at a peripheral edge 22 of the PTC polymer matrix 2 of each chip-sized device for Comparative Example 3. The measured resistance and volume resistivity of the chip-sized devices of Comparative Examples 1-3 are shown in Table 1.

Performance Test

Switching Cycle Test

Ten chips prepared from each of Examples 1-7 and Comparative Examples 1-3 were subjected to a switching cycle test. The switching cycle test for each chip-sized device was conducted under a voltage of 90Vdc and a current of 120 A by switching on for 60 seconds and then off for 60 seconds for each cycle. The number (n) of the chip-sized devices for each of Examples 1-7 and Comparative Examples 1-3 passing 720 switching cycles was recorded, and a passing rate (n/10× 100%) for each of Examples 1-7 and Comparative Examples 1-3 was calculated. The switching cycle test results are shown in Table 2.

Thermal Runaway Test

Ten chip-sized devices prepared from each of Examples 1-7 and Comparative Examples 1-3 were subjected to a thermal runaway test. The thermal runaway test for each chip-sized device was conducted by increasing stepwise the voltage applied to each chip-sized device from an initial voltage of 60Vdc to a breakdown voltage under a fixed current of 50A that is sufficient to enable each chip-sized device to trip at the initial voltage. The applied voltage was increased at an increment of 10Vdc per step and the duration time for each step was 2 minutes (i.e., each newly applied voltage lasted for two minutes). The breakdown voltages were recorded for the chip-sized devices of each of Examples 1-7 and Comparative Examples 1-3, and an average breakdown voltage of the chips of each of Examples 1-7 and Comparative Examples 1-3 was calculated based on the measured breakdown voltages of the chip-sized devices of each of Examples 1-7 and Comparative Examples 1-3. The thermal runaway test results are shown in Table 2.

TABLE 2

| | Switching cycle test (90 Vdc, 120 A, 720 cycles) Passing rate, % | Thermal runaway test (50A, 10 Vdc/step) Breakdown voltage, Vdc |
|---|---|---|
| E1 | 70 | 140 |
| E2 | 70 | 140 |
| E3 | 70 | 140 |
| E4 | 70 | 140 |
| E5 | 70 | 140 |
| E6 | 50 | 130 |
| E7 | 50 | 140 |
| CE1 | 0 | 100 |
| CE2 | 0 | 90 |
| CE3 | 0 | 100 |

The switching cycle test results and the thermal runaway test results demonstrate that formation of at least one hole in the PTC polymer matrix having an effective volume to accommodate expansion of the PTC polymer matrix can have an unexpected improvement in the high-voltage endurability of the insertable PPTC over-current protection device.

While the present invention has been described in connection with what are considered the most practical and preferred embodiments, it is understood that this invention is not limited to the disclosed embodiments but is intended to cover various arrangements included within the spirit and scope of the broadest interpretation and equivalent arrangements.

What is claimed is:

1. An insertable PPTC over-current protection device comprising:

first and second electrodes, each of which has an outer surface and a peripheral edge;

a solder material;

conductive lead pins bonded to said first and second electrodes, respectively, each of said lead pins having a connecting segment extending along and bonded to said outer surface of the respective one of said first and second electrodes through said solder material, and a free segment extending outwardly from said connecting segment beyond said peripheral edge of the respective one of said first and second electrodes; and a PTC polymer matrix laminated between said first and second electrodes and having two opposite surfaces and a peripheral edge, said opposite surfaces of said PTC polymer matrix being in contact with said first and second electrodes, respectively, said PTC polymer matrix being formed with at least one hole that extends between said opposite surfaces of said PTC polymer matrix, that is spaced apart from and that is surrounded by said peripheral edge of said PTC polymer matrix, and that has an effective volume to accommodate thermal expansion of said PTC polymer matrix when temperature of said PTC polymer matrix is increased.

2. The insertable PPTC over-current protection device of claim 1, wherein said hole in said PTC polymer matrix is a through-hole extending through said opposite surfaces of said PTC polymer matrix.

3. The insertable PPTC over-current protection device of claim 1, wherein said hole in said PTC polymer matrix is a blind hole extending through one of said opposite surfaces of said PTC polymer matrix.

4. The insertable PPTC over-current protection device of claim 1, wherein said PTC polymer matrix is made of a PTC composition comprising a non-grafted olefin-based polymer and a conductive filler.

5. The insertable PPTC over-current protection device of claim 4, wherein said PTC composition further comprises an unsaturated carboxylic acid grafted olefin-based polymer.

6. The insertable PPTC over-current protection device of claim 4, wherein said non-grafted olefin-based polymer is high density polyethylene.

7. The insertable PPTC over-current protection device of claim 4, wherein said conductive filler is selected from the group consisting of carbon black, metal powders, and conductive ceramic powders.

8. The insertable PPTC over-current protection device of claim 1, further comprising an encapsulant material enclosing an assembly of said first and second electrodes, said PTC polymer matrix, and a portion of each of said lead pins.

9. The insertable PPTC over-current protection device of claim 8, wherein said encapsulant material is epoxy resin.

* * * * *